United States Patent [19]

Tellie

[11] 3,978,763

[45] Sept. 7, 1976

[54] BUFFER DEVICE FOR A SELF-LOADING SMALL ARM

[75] Inventor: Paul Emile Francois Tellie, Saint-Etienne, France

[73] Assignee: Delegation Ministerielle pour l'Armement, France

[22] Filed: Apr. 14, 1975

[21] Appl. No.: 567,872

[30] Foreign Application Priority Data

May 21, 1974 France ..... 74.17551

[52] U.S. Cl. ..... 89/198

[51] Int. Cl.[2] ..... F41D 11/12

[58] Field of Search ..... 89/198

[56] References Cited

UNITED STATES PATENTS 1,568,005 12/1925 Sutter ..... 89/198

*Primary Examiner*—Stephen C. Bentley

*Attorney, Agent, or Firm*—Stevens, Davis, Miller & Mosher

[57] ABSTRACT

A self-loading small arm which comprises a movable assembly and a buffer device for taking up the recoil energy of the movable assembly. The buffer device includes a spring whose compression is assured via a step-down lever at the end of the recoil stroke of the movable assembly.

14 Claims, 11 Drawing Figures

BUFFER DEVICE FOR A SELF-LOADING SMALL ARM

The present invention relates to self-loading small arms, that is, to firearms which lend themselves to shooting by bursts (complete or possibly limited bursts) and which possibly may be provided with a selection device which permits firing shot by shot. Such firearms are, in general, of a small caliber (generally less than a caliber of 12.7 mm), of a light machine gun type mounted on a carriage having no elastic connection, a machine rifle, an assault rifle, a machine pistol, a submachine gun, etc.

It is already known to provide such arms with a receiver mechanism which comprises, inter alia, a movable assembly imparted with a reciprocating longitudinal movement within a receiver and subjected to the action of an elastic return system (hereinafter called "recuperator system") which is compressed during the entire recoil stroke of the movable assembly. Restitution of the energy stored due to the compression assures the forward return stroke (return stroke to firing position) of the movable assembly.

It is also known to provide firearms of this type with a buffer device located at the rear of the receiver of the firearm in a position such that the movable assembly of the receiver at the end of the recoil stroke strikes against this buffer device. This striking compresses an elastic apparatus and produces frictional forces which favor the dissipation of part of the recoil energy of the movable assembly whose return forward is assured essentially by the recuperator system cooperating permanently with this movable assembly, the buffer device progressively resuming its initial position while the movable assembly effects its forward return stroke practically under the action alone of the recuperator system.

It follows from the foregoing that in firearms of the type in question, on the one hand, the recuperator system participating in all of the forward and return movements of the movable assembly is a distinct element and entirely independent from the buffer device which participates only at the end of the recoil stroke of the movable assembly. On the other hand, the buffer device restores practically no energy to the movable assembly, the latter effecting its return stroke to the firing position essentially under the action of its recuperator system.

The buffer device of the firearms of the type in question is therefore a purely buffering device and is not to be confused with devices (frequently provided on weapons of larger caliber, for instance of 20 to 30 mm) which act both as a buffer (for the end of the recoil stroke of the movable assembly) and as an accelerator (jointly with a recuperator system on the start of the battery return stroke to the firing position of the movable assembly).

With this clarification of what is meant in the field of self-loading small arms by the expressions "recuperator system" and "buffer device," it should be pointed out, before describing the main arrangement of the invention, that the buffer devices of firearms of this type were constituted up to the present time by a compression spring placed in a cylindrical housing (located in the axis of the weapon) and subjected to the action of a push member arranged on the end of the recoil path of the movable assembly of the weapon. This compression spring imprisons between its turns sections of turns which, by a wedging effect, produce frictional forces reinforcing the buffer effect during the compressive stroke of the device and favor a progressive return of the spring and of the push member towards their initial position once the movable assembly has been violently propelled forward by its recuperator system.

Such buffer devices with compression springs, which have a cylindrical configuration include incorporated sections of turns arranged on the end of the recoil path of the movable assembly and are acted on directly by the movable assembly, and make it possible of course to obtain the purely buffer effect desired. But on the other hand, they have certain drawbacks, among which mention may be made in particular of (1) an increased length of the weapon, (2) irregularities in operation due to variations in the process of the wedging of the turns between themselves and against the walls of their housing, these irregularities resulting in substantial differences in the intensity of the force which must be borne by the marksman or by the mount, and this resulting in a loss of precision of the burst firing, and (3) the short compressive stroke of the push member spring which at times results in an excessive level of intensity of the recoil forces sustained by the marksman or by the mount of the weapon if the latter is arranged on such a mount.

The object of the invention is specifically to provide a self-loading small arm having a buffer device which does not present, or in any event presents only to a far lesser extent, the drawbacks mentioned above of the conventional buffer devices with the push spring and incorporated sections of turns acted on directly by the movable assembly of the weapon.

The self-loading small arm in accordance with the invention comprises, inter alia, on the one hand a receiver in which a movable assembly belonging to the receiver mechanism of the weapon moves in longitudinal reciprocation and, on the other hand, a buffer device located towards the rear of the receiver and having an elastic device which is adapted towards the end of the recoil stroke of the movable assembly to take up part of the recoil energy of the movable assembly. The elastic device is arranged in a housing which is off-center with respect to the axis of the weapon and located at the level of the rear portion of the receiver proper of the weapon, the housing possibly being located above the receiver. The buffer device comprises, for the transmission of the recoil energy of the movable assembly to the elastic device, a step-down lever whose axis of articulation is directed transversely in the off-center housing, the large arm of which protrudes to the inside of the receiver while its small arm bears at least one cam adapted to cooperate, via a corresponding stop, with the elastic device of the buffer device. The cam and the corresponding stop are so arranged that, with due consideration of the position of the axis of articulation of the step-down lever, for all the relative positions of contact of the cam and the stop the central axis of the axis of articulation is located at the outside but in the immediate vicinity of the maximum angle of friction foreseeable for the parts of the cam and the stop in contact.

It should be pointed out that by the expression "maximum foreseeable angle of friction" there is understood here the angle of friction in connection with the portions of the cam and the stop in contact with each other, corresponding to the most unfavorable conditions of sliding which can be contemplated upon the use of the weapon (dust, sand, mud, etc.).

As to the expression "immediate proximity" to the central axis of the axis of articulation of the step-down lever, it is preferably determined so as to obtain optimum operation of the buffer in such a manner that the coefficient of friction tan $\alpha$ corresponding to the aforementioned maximum angle of friction and the angular polar coordinate $\beta$ of the central axis from the point of contact of the cam and of the stop satisfy the twofold inequality $$1.1 \tan \alpha \leq \sin \beta \leq 1.25 \tan \alpha$$

On the basis of these clarifications and in accordance with the invention one then has a self-loading small arm equipped with a buffer device which does not have the above mentioned drawbacks of the conventional buffer devices. That is, it (1) does not cause an additional length of the weapon to the rear of the receiver, (2) is of uniform operation due to the buffer by friction produced at the contact of the cam and the stop, and (3) has an elastic device the stroke of which is greater than the buffer stroke of the movable assembly of the weapon (reduced recoil forces transmitted to the marksman and kick moment of the weapon reduced in the case of a weapon shot from the shoulder).

From the point of view of design, one can then arrange the buffer device either parallel to the longitudinal axis of the weapon or in such a manner that it forms a certain angle (for instance a right angle) with the longitudinal axis, in particular in order to house the buffer device in a butt when the weapon actually has such a butt.

Preferably, the articulation pin of the step-down lever is removable so as to facilitate disassembly of the buffer device.

Preferably also the elastic device of the buffer device is so arranged as to operate in compression at the end of the recoil stroke of the movable assembly.

The buffer device can then be a single-acting device, its step-down lever having a single cam associated with a single stop. In this case, this single stop can, furthermore, (1) either be a fixed stop, the pin of the step-down lever being then borne by a sliding part which participates in the entire stroke of deformation of the elastic device, (2) or be a movable stop participating in the entire stroke of deformation of the elastic device, the pin of the step-down lever being then rigidly connected with the receiver of the weapon, or else (3) be a fixed stop associated with a shock absorber, in which case the pin of the step-down lever is borne by a sliding part which participates in the entire deformation stroke of the elastic device.

However, the buffer device may, in accordance with another solution, be a double acting device and then have two cams associated respectively with two separate stops, at least one of which must be a moving stop participating in the entire deformation stroke of the elastic device, the pin of the step-down lever being possibly a stationary pin in the event that the two stops are movable, but, on the other hand, having to be mounted with a degree of freedom along the axis of the weapon when one of the two stops is fixed.

A number of preferred embodiments illustrating the preceding arrangements will now be described with reference to the accompanying drawings.

FIGS. 1 and 2 show, in axial vertical section and in cross section along the line II—II in FIG. 1, respectively, the rear portion of an assault rifle provided with a buffer device established in accordance with a first embodiment of the invention.

FIG. 1*a* is a diagram which explains the frictional forces involved in the buffer device.

Figure 1:
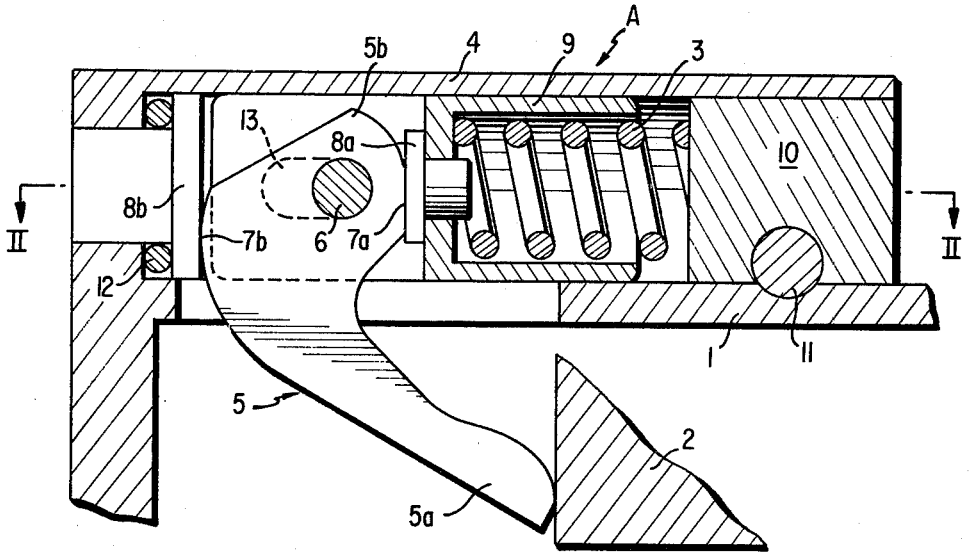
Figure 2:
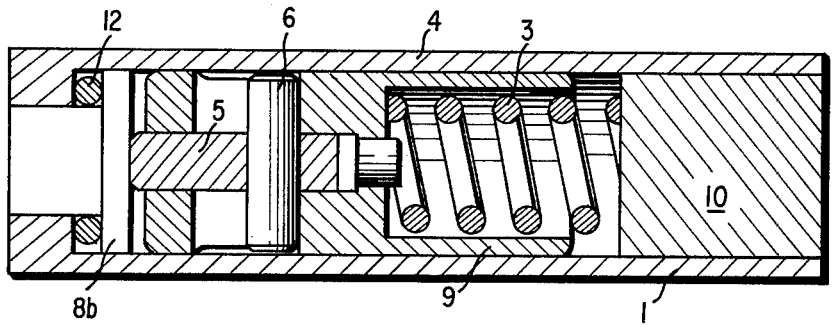

In FIGS. 1 and 2 there is shown the rear portion of an assault rifle comprising, inter alia, a receiver 1 in which a movable assembly 2 (breech block and/or maneuvering part, for instance) forming part of the receiver mechanism of the weapon moves with a longitudinal reciprocation and a buffer device, designated as a whole by A, located towards the rear of the receiver 1 and having a coil spring 3 adapted towards the end of the recoil stroke of the movable assembly 2, to absorb part of the recoil energy of the movable assembly.

The coil spring 3 is arranged in a housing 4 rigidly connected with the receiver 1 and shifted upward with respect to the axis of the weapon.

The recoil energy of the movable assembly 2 is transmitted to the spring 3 via a step-down lever 5 pivoted on a removable transverse pin 6 and whose large arm 5*a* protrudes to the inside of the receiver 1 while its small arm 5*b* protrudes into the housing 4 of the spring 3. The lever 5 bears at least one cam adapted to cooperate, while resting against a corresponding stop, with the spring 3 causing the compression of the spring at the end of the recoil stroke of the movable assembly 2.

In the case of this embodiment, the lever 5 bears two cams. A first cam 7*a* is located on the same side as the spring 3 and cooperates with a corresponding movable stop 8*a* borne by a slide 9 which surrounds the rear end of the spring 3, the front end of which rests against a stop plug 10 which is held rigidly secured to the receiver 1 by a key 11. A second cam 7*b* is located on the opposite side and cooperates with a corresponding stationary stop 8*b* arranged at the rear end of the housing 4, preferably with the interposition of an elastic stop ring or shock absorber 12.

The pivot pin 6 is borne by the lever 5 and its ends are engaged in two elongated slots 13 provided in extensions of the slide 9.

Figure 1A:
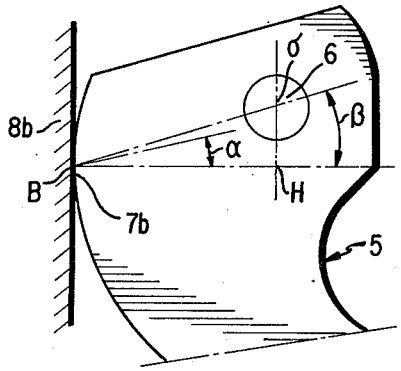

In any event, each cam and the corresponding stop must satisfy, with respect to the conditions of relative sliding of these parts, the following conditions which will be explained below with reference to the cam 7*b* and the stop 8*b*, and with reference to FIG. 1*a*.

If one designates B the point of contact of the cam 7*b* with the corresponding stop 8*b*, BH the normal to the stop at this point of contact, BO the line passing through the point of contact and the central axis of the pivot pin 6, $\beta$ the angle of the lines BO and BH and $\alpha$ the maximum angle of friction to be contemplated, then on the one hand, the point O must be located to the outside of and in the immediate vicinity of the angle $\beta$ and, on the other hand, preferably the various parameters just mentioned must satisfy the twofold inequality:

$$1.1 \tan \alpha \leq \sin \beta \leq 1.25 \tan \alpha$$

With such a buffer device, when the movable assembly 2, at the end of the recoil stroke, encounters the branch 5*a* of the lever 5, the lever and the pin 6 recoil slightly, crushing the elastic stop ring 12. The lever 5 thus swings in a clockwise direction resting via its cam 7*b* against the stop 8*b* and compressing the spring 3 by the action of the cam 7*a* on the moving stop 8*a*. A large part of the recoil energy of the movable assembly 2 therefore is dissipated by friction in the zones of contact of the cams 7*a* and 7*b* with the corresponding stops 8*a* and 8*b*.

Once the recoil stroke of the movable assembly 2 has been completed, the latter is violently returned forward by its recuperator system (not shown) and the elements of the buffer device are gradually returned to their initial position by the release of the spring 3, which release is retarded by the frictional forces produced at the contacts of the cams 7*a* and 7*b* with the corresponding stops 8*a* and 8*b*.

Figure 3:
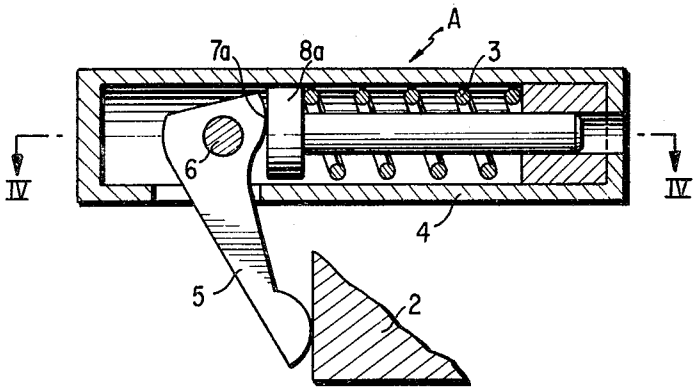
FIGS. 3 and 4 illustrate, in axial vertical section and in cross section along the line IV—Iv of FIG. 3, respectively, a second embodiment of the buffer device.
Figure 4:
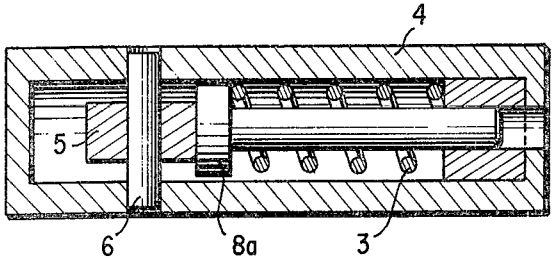

In FIGS. 3 and 4, an embodiment of the buffer device A is shown which differs from that illustrated in FIGS. 1 and 2 in that (1) the stop-down lever 5 bears a single cam 7*a* cooperating with a movable stop 8*a* located on the same side as the buffer spring 3, and (2) the pivot pin 6 of the lever 5 is fixed with respect to the housing 4 of the buffer spring, which housing is itself rigidly connected with the receiver of the firearm.

Figure 5:
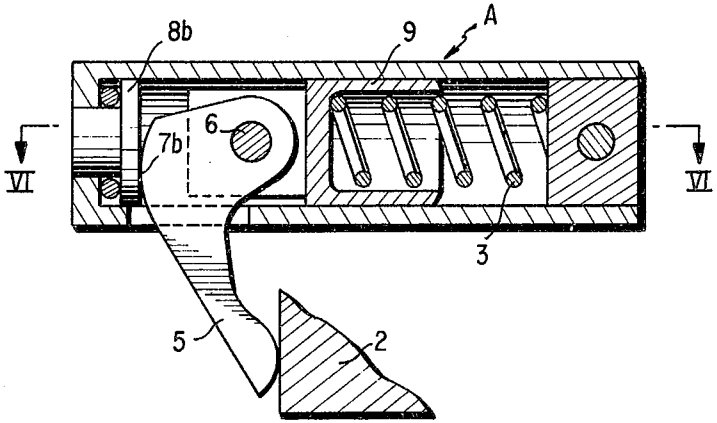
FIGS. 5 and 6 illustrate, in axial vertical section and in cross section along the line VI—VI in FIG. 5, respectively, a third embodiment of the buffer device.
Figure 6:
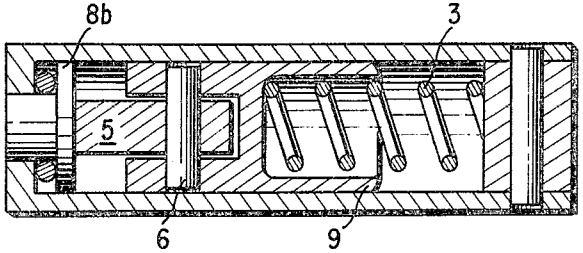

In FIGS. 5 and 6 there is shown an embodiment of the buffer device A in which the step-down lever 5 bears a single cam 7*b* cooperating with a fixed stop 8*b* located, with respect to the pivot pin 6, on the side opposite the spring 3, and the pivot pin 6 is rigidly connected in translation with the slide 9 which covers the end of the spring 3.

Figure 7:
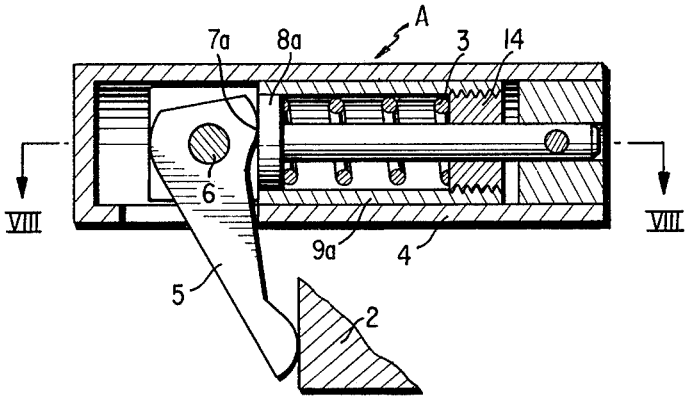
FIGS. 7 and 8 illustrate, in axial vertical section and in cross section along the line VIII—VIII of FIG. 7, respectively, a fourth embodiment of the buffer device.
Figure 8:
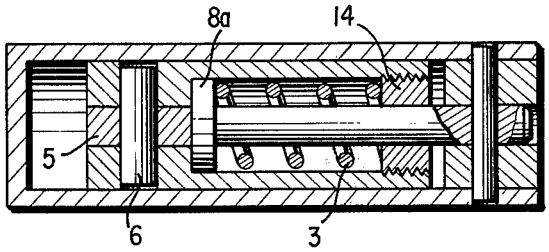

In FIGS. 7 and 8 there is shown an embodiment of the buffer device A in which the step-down lever 5 bears a single cam 7*a* cooperating with a fixed stop 8*a* located on the same side as the spring 3, and the pin 6 of the step-down lever is rigidly connected in translation with a slide 9*a* which, via an end plug 14, rests against the front end of the spring 3.

Figure 10:
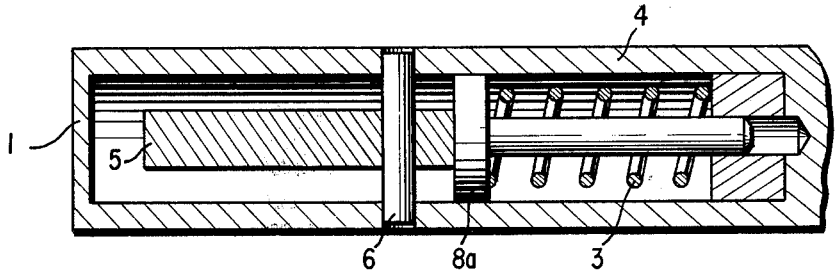
FIGS. 9 and 10 show, in axial vertical section and in cross section along the line X—X of FIG. 9, respectively, a fifth embodiment of the buffer device.
Figure 9:
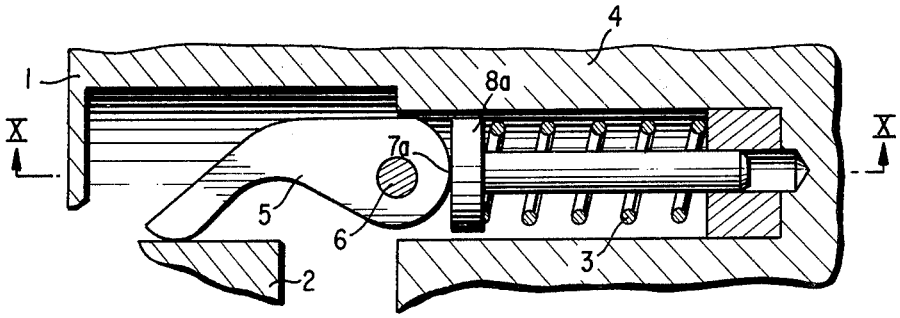

Finally, in FIGS. 9 and 10 there is shown an embodiment of the buffer device A in which the housing 4 of the buffer device A extends perpendicularly to the axis of the firearm and below the rear portion of the receiver 1, and the step-down lever 5, whose pin 6 is rigidly connected with the housing 4, bears a single cam 7*a* located on the same side as the spring 3 and cooperating with a movable stop 8*a*, the housing 4 being arranged for instance in the butt of the firearm.

It goes without saying and furthermore as is already evident from the foregoing, the invention is in no way limited to one of its methods of application nor to the embodiments of its various parts which have been more particularly indicated; rather it covers all variants.

What is claimed is:

1. A self-loading small firearm, comprising:

a. a receiver including a movable recoilable assembly which reciprocates longitudinally in the firearm; and b. a buffer device, connected to the rear of said receiver, including a housing which is offset with respect to the axis of the firearm and connected at the same level as the rear of said receiver, an elastic device, connected within said housing, for absorbing part of the recoil energy of said movable assembly towards the end of a recoil stroke of said movable assembly, and means for transmitting the recoil energy of said movable assembly to said elastic device, said transmitting means including a step-down lever having a pivot pin connected within and in the transverse direction of said housing, a large arm protruding into said receiver and a small arm having a first cam, and a first stop connected within said housing and contacting said first cam, said small arm cooperating with said elastic device via said first cam and said first stop, wherein said pivot pin is located with respect to all points of contact of said first cam and said first stop such that the central axis (O) of said pivot pin is located outside but in the immediate vicinity of a predetermined maximum angle of friction ($\alpha$) for the points of contact.

2. A firearm according to claim 1, wherein said central axis (O) is located such that if the angular polar coordinate of said central axis (O) is designated by $\beta$ then the following double inequality is satisfied:

$$1.1 \tan \alpha \leq \sin \beta \leq 1.25 \tan \alpha$$

3. A firearm according to claim 1, wherein said pivot pin is removable.

4. A firearm according to claim 1, wherein said buffer device extends parallel to the longitudinal axis of the firearm.

5. A firearm according to claim 1, wherein said buffer device forms a predetermined angle with the longitudinal axis of the firearm.

6. A firearm according to claim 5 further comprising a butt, said buffer device being housed in said butt.

7. A firearm according to claim 1, wherein said elastic device is in compression at the end of the recoil stroke of said movable assembly.

8. A firearm according to claim 1, wherein said buffer device is single acting and comprises a single cam and a single stop.

9. A firearm according to claim 8, wherein said single stop is fixed and wherein said means for transmitting includes a sliding part, connected to said pivot pin and said elastic device, for deforming said elastic device.

10. A firearm according to claim 8, wherein said single stop is movable and connnected to said elastic device to deform said elastic device and wherein said pivot pin is fixed with respect to said receiver.

11. A firearm according to claim 8, further comprising a shock absorber, and wherein said single stop is fixed and connected to said shock absorber, and wherein said means for transmitting includes a sliding part, connected to said pivot pin and said elastic device, for deforming said elastic device.

12. A firearm according to claim 1, wherein said buffer device is double acting, wherein said means for transmitting further comprises a second cam, and a second stop contacting said second cam, at least one of said first and second stops being a movable stop connected to said elastic device to deform said elastic device.

13. A firearm according to claim 12, in which said first and second stops are movable, and wherein said pivot pin is fixed with respect to said receiver.

14. A firearm according to claim 12, in which one of said first and second stops is fixed and the other movable, and wherein said pivot pin is connected with a degree of freedom along the axis of the firearm.

* * * * *